US009255563B2

(12) United States Patent
Eisen et al.

(10) Patent No.: US 9,255,563 B2
(45) Date of Patent: Feb. 9, 2016

(54) METHOD FOR OPERATING AN IGNITION DEVICE FOR AN INTERNAL COMBUSTION ENGINE AND IGNITION DEVICE FOR AN INTERNAL COMBUSTION ENGINE FOR CARRYING OUT THE METHOD

(75) Inventors: Sven-Michael Eisen, Regensburg (DE); Stephan Bolz, Pfatter (DE); Harald Schmauβ, Donaustauf (DE); Achim Reuther, Donaustauf (DE); Martin Götzenberger, Ingolstadt (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 357 days.

(21) Appl. No.: 13/988,766

(22) PCT Filed: Nov. 9, 2011

(86) PCT No.: PCT/EP2011/069775

§ 371 (c)(1),
(2), (4) Date: Jul. 29, 2013

(87) PCT Pub. No.: WO2012/069316

PCT Pub. Date: May 31, 2012

(65) Prior Publication Data

US 2013/0291833 A1 Nov. 7, 2013

(30) Foreign Application Priority Data

Nov. 23, 2010 (DE) ..... 10 2010 061 799

(51) Int. Cl.
*F02P 9/00* (2006.01)
*F02P 3/04* (2006.01)
(Continued)

(52) U.S. Cl.
CPC ... *F02P 9/00* (2013.01); *F02P 3/04* (2013.01); *F02P 3/0442* (2013.01); *F02P 3/05* (2013.01); *F02P 3/053* (2013.01); *F02P 15/08* (2013.01); *F02P 17/12* (2013.01)

(58) Field of Classification Search
CPC ..... F02P 9/00; F02P 3/04; F02P 3/05
USPC ..... 123/406.12, 644, 623; 701/113
See application file for complete search history.

(56) References Cited

U.S. PATENT DOCUMENTS 5,914,604 A 6/1999 Bahr et al. ..... 324/399
6,032,657 A 3/2000 Rossi et al. ..... 123/625
(Continued)

FOREIGN PATENT DOCUMENTS

DE 69703484 T2 3/2001 ..... F02P 15/08
DE 102004056844 A1 6/2006 ..... F02P 15/08
(Continued)

OTHER PUBLICATIONS

International Search Report and Written Opinion, Application No. PCT/EP2011/069775, 18 pages, Mar. 13, 2013.

*Primary Examiner* — Mahmoud Gimie
(74) *Attorney, Agent, or Firm* — Slayden Grubert Beard PLLC

(57) ABSTRACT

A method is disclosed for operating an ignition device for an internal combustion engine, said device having an ignition coil designed as a transformer, an igniter plug connected to the ignition coil secondary winding, a controllable switching element connected in series to the ignition coil primary winding and a control unit connected to the ignition coil primary winding and the control input of the switching element, wherein the control unit provides a supply voltage for the ignition coil and a control signal for the switching element depending upon the flows through the ignition coil primary and secondary winding and the voltage between the connection point of the ignition coil primary winding to the switching element and the negative terminal of the supply voltage, to provide an adjustable alternating current for the igniter plug, to provide a targeted supply of power distributed over the ignition time interval.

9 Claims, 3 Drawing Sheets

(51) Int. Cl.

| | |
|---|---|
| ***F02P 3/05*** | (2006.01) |
| ***F02P 15/08*** | (2006.01) |
| ***F02P 17/12*** | (2006.01) |

(56) References Cited

U.S. PATENT DOCUMENTS

| | | | | |
|---|---|---|---|---|
| 6,763,815 | B2 * | 7/2004 | Gerhardt et al. | 123/609 |
| 2001/0039941 | A1 * | 11/2001 | Yamada et al. | 123/406.14 |
| 2008/0011281 | A1 | 1/2008 | Kraus et al. | 123/623 |
| 2008/0121214 | A1 | 5/2008 | Bertsch et al. | 123/406.12 |
| 2008/0184977 | A1 | 8/2008 | Lepley | 123/596 |
| 2011/0270506 | A1 | 11/2011 | Maier et al. | 701/102 |
| 2012/0186569 | A1 * | 7/2012 | Shimakawa et al. | 123/644 |
| 2012/0312285 | A1 | 12/2012 | Bolz et al. | 123/623 |
| 2013/0263835 | A1 * | 10/2013 | Eisen et al. | 123/623 |
| 2015/0008838 | A1 * | 1/2015 | Reuther et al. | 315/209 T |

FOREIGN PATENT DOCUMENTS

| | | | | |
|---|---|---|---|---|
| DE | 102008006304 | A1 | 8/2008 | F02P 15/10 |
| DE | 102007034390 | A1 | 1/2009 | F02P 3/05 |
| DE | 102007034399 | A1 | 1/2009 | F02P 3/05 |
| DE | 102007051249 | A1 | 4/2009 | F02P 9/00 |
| DE | 102009026424 | A1 | 12/2009 | F02P 15/00 |
| DE | 102009057925 | A1 | 6/2011 | F02P 3/05 |
| EP | 0790406 | A2 | 8/1997 | F02P 15/10 |
| EP | 1854997 | A2 | 11/2007 | F02P 3/045 |
| WO | 2012/069316 | A1 | 5/2012 | F02P 15/08 |

* cited by examiner

METHOD FOR OPERATING AN IGNITION DEVICE FOR AN INTERNAL COMBUSTION ENGINE AND IGNITION DEVICE FOR AN INTERNAL COMBUSTION ENGINE FOR CARRYING OUT THE METHOD

CROSS-REFERENCE TO RELATED APPLICATIONS

This application is a U.S. National Stage application of International Application No. PCT/EP2011/069775 filed Nov. 9, 2011, which designates the United States of America, and claims priority to DE Application No. 10 2010 061 799.7 filed Nov. 23, 2010, the contents of which are hereby incorporated by reference in their entirety.

TECHNICAL FIELD

The present disclosure relates to operational aspects of an ignition device for an internal combustion engine.

BACKGROUND

Series ignition systems in contemporary internal combustion engines which are embodied as spark ignition engines having been operating for many decades according to the simple and reliable principle of coil discharge, i.e. an ignition coil which is configured as a transformer is charged partially as far as its saturation range on the primary side in accordance with its inductance from the vehicle on-board power system voltage. At the ignition time, the charge is interrupted by means of an electronic switching operation, for example by an ignition-IGBT (Insulated Gate Bipolar Transistor). As a result, a voltage of, for example, 5 kV to 35 kV is built upon the secondary side and gives rise to a flashover in the spark gap of the sparkplug in the combustion chamber of the internal combustion engine. The energy which is stored in the coil is subsequently dissipated in the ignition plasma.

In the course of the progressive development of engines, it has been necessary to implement reductions in terms of consumption and emissions, and in the last few years these have consequently placed an increasing additional burden on the ignition system and will continue to do so in the future. Examples of this are, for example, stratified combustion in which liquid fuel components with high flow rates impede the spark discharge and bring about numerous new spark formations. Rising combustion chamber pressures for improving the engine efficiency also increase the breakdown resistance in the spark gap and bring about an increase in the breakdown voltage which also influences the sparkplug wear. In future highly charged engine generations the latter will give rise to secondary-side voltage increases far beyond 35 kV. Both the rising breakdown voltages and the flow states which become more intensive at the sparkplug have a tendency to shorten the spark duration of the sparks since ever larger proportions of the energy stored in the coil have to be made available to build up and maintain the spark. A much more promising trend in the development of new combustion methods is the use of multiple sparks, in which the coil energy is transmitted efficiently to the mixture at short intervals, which increases the inflammation reliability.

In application DE 10 2009 057 925.7, which was not published before the priority data of the present document, an innovative method for operating an ignition device for an internal combustion engine and an innovative ignition device for an internal combustion engine for carrying out the method are described. Accordingly, an ignition device for an internal combustion engine is formed with an ignition coil which is embodied as a transformer, a sparkplug which is connected to the secondary winding of the ignition coil, a controllable switching element which is connected in series to the primary winding of the ignition coil, and a control unit which is connected to the primary winding of the ignition coil and to the control input of the switching element. The control unit makes available an adjustable supply voltage for the ignition coil and a control signal for the switching element as a function of the currents through the primary winding and the secondary winding of the ignition coil and as a function of the voltage between the connecting point of the primary winding of the ignition coil to the switching element and to the negative terminal of the supply voltage. The method for operating this device has the following sequence in this context:

in a first phase (charging), the switching element is switched on at a first switch-on time through the control signal and switched off again at the predefined ignition time, in a subsequent second phase (breakdown), the primary voltage or a voltage derived therefrom is compared with a first threshold value, and when this voltage undershoots the first threshold value the switching element is switched on again at a second switch-on time, in a subsequent third phase (arc) the supply voltage is regulated in such a way that the current through the secondary winding of the ignition coil corresponds approximately to a predefined current, and the current through the primary winding of the ignition coil is compared with a predefined second threshold value, and when this current exceeds the second threshold value the switching element is switched off again at a first switch-off time, in a subsequent fourth phase (breakdown), the current through the secondary winding of the ignition coil is compared with a third threshold value, and when this current undershoots the third threshold value the switching element is switched on again at a third switch-on time, the third and the fourth phases are, if appropriate, subsequently repeated until a predefined spark duration is reached under the time at which the switching element is definitively switched off.

A corresponding device is illustrated in FIG. 1, and the time profile of the significant voltages and currents is illustrated in FIG. 2.

Investigations into the basic principles of internal combustion engines have shown that the interaction of the internal cylinder flow with a spark of the sparkplug has a considerable influence on the spark itself as well as consequently on the quality of the ignition and inflammation of various mixture states. Even in the case of weak flow states far below 5 m/s, the spark is deflected in the spark gap, which deflection becomes continuously larger as the effect persists.

Moderate flow speeds have a positive effect on the running of the engine despite shortening of the spark duration since they have a tendency to increase the spark volume and improve the transmission of heat to the surrounding mixture. In terms of ignition technology, particularly in the short range area, in a few millimeters around the sparkplug prove problematic since both the ignition hook and the sparkplug body itself constitute considerable heat sinks and large portions of the heat in the plasma are absorbed in the form of radiation, convection or simply thermal conduction and are unavailable for heating the mixture. Even after successful ignition, these heat sinks impede the initial growth of the flame and delay the combustion sequence which is so critical at the beginning.

The introduction of multiple sparks or series sparks improves the situation by virtue of the fact that an intermittent supply of energy with simultaneous extension over time slightly increases the ignition probability when there is a lack of homogenization of the mixture. Although through the extension over time the ignition times become slightly imprecise, on the other hand greater extension of the plasma is promoted given a sufficiently high spark frequency and spark energy content. Even relatively high spark energies can improve the inflammability at the cost of increased sparkplug wear.

The maximum extension of the plasma which can be achieved as a function of the combustion chamber pressure and flow (turbulence) and which is specific to the respective operating state of the engine and defines the most efficient "far-range area" of the sparkplug in terms of inflammation technology has not been considered until now.

SUMMARY

One embodiment provides a method for operating an ignition device for an internal combustion engine which is formed with an ignition coil which is embodied as a transformer, a sparkplug which is connected to the secondary winding of the ignition coil, a controllable switching element which is connected in series with the primary winding of the ignition coil, and a control unit which is connected to the primary winding of the ignition coil and to the control input of the switching element, wherein the control unit makes available a supply voltage for the ignition coil and a control signal for the switching element as a function of the currents through the primary winding and the secondary winding of the ignition coil and of the voltage between the connecting point of the primary winding of the ignition coil to the switching element and to the negative terminal of the supply voltage, wherein energy is transported in the ignition sparks of the sparkplug by alternatively switching the switching element on and off as a function of threshold values for the primary voltage or a voltage derived therefrom, for the current through the primary winding of the ignition coil and for the current through the secondary winding of the ignition coil, being undershot or exceeded, wherein at least one of these threshold values is determined as a function of engine state data, wherein during the phases in which the switching element is switched off, the voltage induced in the secondary winding of the ignition coil is measured by means of the current through the secondary winding of the ignition coil or by means of the voltage, transformed back by the ignition coil, at the primary winding of the ignition coil, and wherein the function according to which the at least one threshold value is dependent on the engine state data is changed as a function of this measured current through the secondary winding or the measured voltage at the primary winding.

In a further embodiment, the function according to which the at least one threshold value is dependent on the engine state data is defined by a characteristic data diagram.

In a further embodiment, the engine state data comprise at least the ignition time and/or the rotational speed.

In a further embodiment, the current through the secondary winding of the ignition coil or of the measured voltage at the primary winding is measured discretely by means of breakdown threshold values.

Another embodiment provides an ignition device for an internal combustion engine which is formed with an ignition coil which is embodied as a transformer and whose secondary winding is designed for connection to a sparkplug, having a controllable switching element which is connected in series to the primary winding of the ignition coil, and having a control unit which is connected to the primary winding of the ignition coil and to the control input of the switching element, wherein the control unit for carrying out any of the methods disclosed above is formed with a voltage converter which makes available, at its output a supply voltage for the ignition coil and can be connected to a motor vehicle on-board power system voltage, and is formed with a control circuit which changes the threshold values for the primary voltage or a voltage derived therefrom, the current through the primary winding of the ignition coil and the current through the secondary winding of the ignition coil as a function of the current, measured during the off phases of the switching element, through the secondary winding of the ignition coil or as a function of the voltage measured at the primary winding of the ignition coil, which voltage occurs as a result of the back transformation of the voltage at the secondary winding of the ignition coil by the ignition coil.

In a further embodiment, a characteristic data diagram in which a number of different characteristic data are stored which can be assigned to a corresponding number of values for the current through the secondary winding or the voltage at the primary winding of the ignition coil is stored in the control circuit.

BRIEF DESCRIPTION OF THE DRAWINGS

Exemplary embodiments will be explained in more detail below based on the schematic drawings, wherein.

DETAILED DESCRIPTION

Figure 1:
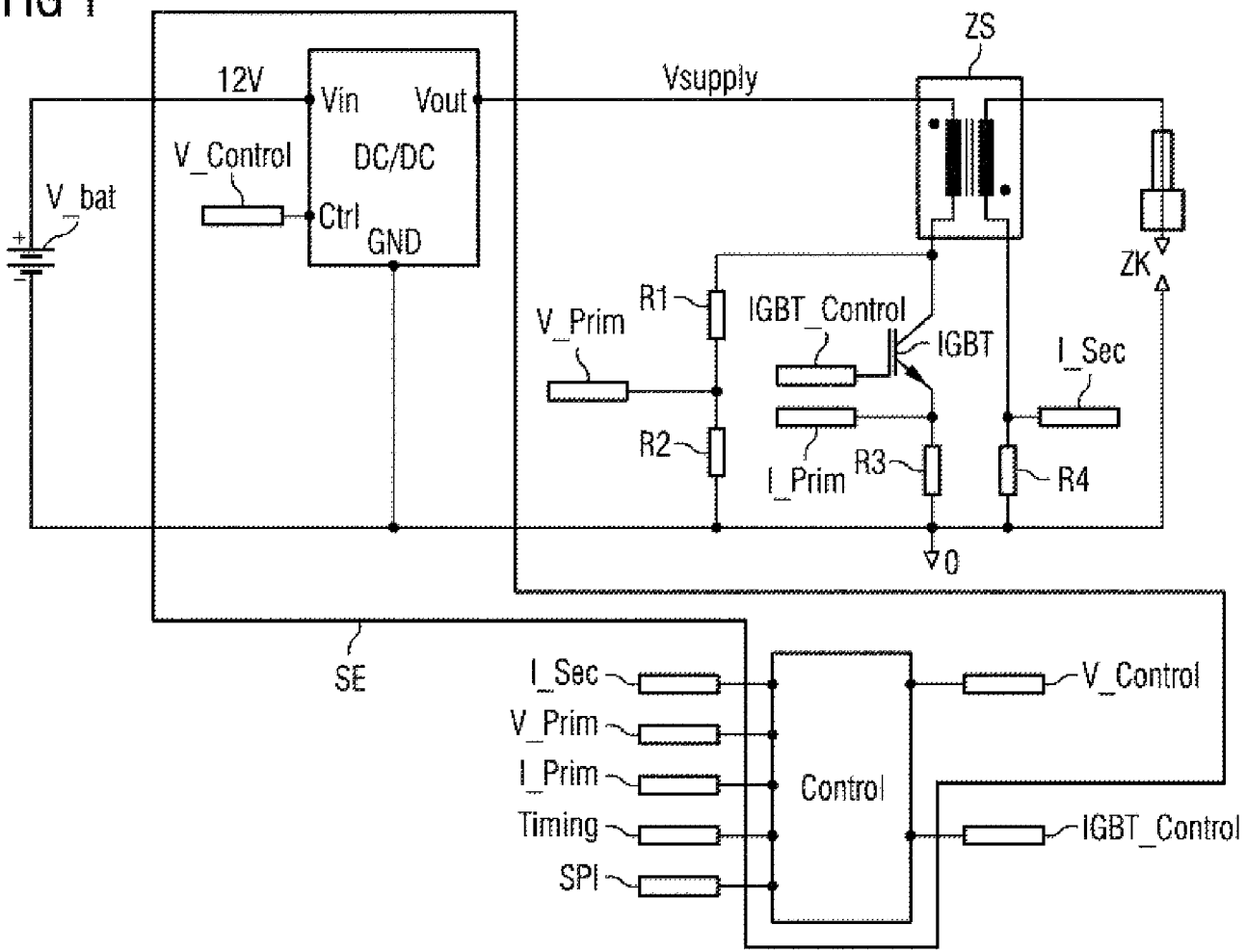
FIG. 1 shows a block diagram of an ignition device according to one embodiment.

Embodiments of the present invention may achieve distribution of the supply of energy in a way which is optimized with respect to the ignition interval.

For example, some embodiments provide a method for operating an ignition device for an internal combustion engine which is formed with an ignition coil which is embodied as a transformer, a sparkplug which is connected to the secondary winding of the ignition coil, a controllable switching element which is connected in series to the primary winding of the ignition coil, and a control unit which is connected to the primary winding of the ignition coil and to the control input of the switching element.

In this context, the control unit makes available a supply voltage for the ignition coil and a control signal for the switching element as a function of the currents through the primary winding and the secondary winding of the ignition coil and of the voltage between the connecting point of the primary winding of the ignition coil to the switching element and to the negative terminal of the supply voltage, wherein energy is transported in the ignition sparks of the sparkplug by alternatively switching the switching element on and off as a function of threshold values for the primary voltage or a voltage derived therefrom being undershot or exceeded, for the current through the primary winding of the ignition coil and for the current through the secondary winding of the ignition coil, wherein at least one of these threshold values is determined as a function of engine state data, wherein during the phases in which the switching element is switched off, the voltage induced in the secondary winding of the ignition coil is measured by means of the current through the secondary winding of the ignition coil or by means of the voltage, transformed back by the ignition coil, at the primary winding of the ignition coil, and wherein the function according to which the at least one threshold value is dependent on the engine state data is changed as a function of this measured current through the secondary winding or the measured voltage at the primary winding.

Some embodiments or the method are based on the realization that the amplitude of the voltage applied to the secondary winding of the ignition coil is a measure of the state of the spark plasma. The amplitude makes it possible to discern here whether a new spark formation, a partial breakdown (i.e. shortening of pre-ionized plasma sections) or of consequent sparks as a result of continued expansion of the plasma (i.e. the use of existing plasma sections). In this context, the greatest significance is assigned to the detection of the partial breakdown since the latter defines the time of the maximum extension of the plasma in the respective operating state. Optimum distribution of the energy supply can be ensured on the basis of this information by controlling the energy supply in the ignition time interval.

This is done by changing at least one of the threshold values whose undershooting are exceeding by the measured voltages and currents is used to switch the switching element on and off. As a result, for example early switching of the switching element can be brought about so that the switching frequency can be increased and more energy can be made available in the ignition sparks in the ignition time interval.

Given knowledge of the period of time from the breakdown of the spark up to the maximum extension of the plasma, an ignition strategy can be configured in such a way that a large part of the entire coil energy is preferably introduced in the last third of the spark gap, in order therefore to ensure a high level of efficiency during the transmission of heat from the spark to the mixture.

The voltage which is induced in the secondary winding and whose direct measurement is complex and costly owing to the values in the kV range in the series production, can be advantageously measured by measuring the current through the secondary winding or the voltage transformed back by the ignition coil at the primary winding.

The function according to which the at least one threshold value is dependent on the engine state data is advantageously defined by a characteristic data diagram.

In this context, in one development it is advantageous if the engine state data comprise at least the ignition time and/or the rotational speed.

It is therefore possible to form a closed loop control circuit wherein pilot control in which the characteristic diagram data is cyclically updated is also possible. This has the advantage that the spark energy can be reduced with the same inflammation power. This increases the service life of the sparkplug.

The current through the secondary winding of the ignition coil or of the voltage at the primary winding is measured as a back-transformed voltage at the secondary winding of the ignition coil can take place continuously, but according to one embodiment it is only advantageous to carry out the determining process once on the basis of discrete breakdown threshold values.

Owing to the measurement of the current through the secondary winding or of the voltage at the primary winding as a back-transformed voltage at the secondary winding of the ignition coil, the time of the spark breakaway can be detected and on the basis of the period of time up to this spark breakaway it is possible to infer the prevailing speed of the flow inside the cylinder. By using this data it is possible to influence further manipulated variables of the engine, such as, for example, the throttle valve position or the valve stroke.

Given knowledge of the breakdown current at the respective operating point, the degree of wear on the sparkplug can also be determined and, if appropriate, input as a fault in the control unit and/or output as a message to the driver.

Other embodiments provide an ignition device for an internal combustion engine. Advantageous developments are specified in the dependent claims.

The ignition device according to FIG. 1 includes a controllable supply voltage source DC/DC which is embodied as a voltage converter for supplying one or more ignition coils ZS with a supply voltage Vsupply which is variable as appropriate. It is supplied from the on-board power system voltage V_bat of currently approximately 12 V. It supplies one or more ignition coils ZS, wherein a blocking diode is advantageously no longer necessary. It is possible to use customary sparkplugs ZK which are connected to the secondary winding of the ignition coil ZS. The primary winding of the ignition coil ZS is connected in series with a switching element which is usually embodied as an IGBT and has the purpose of switching the ignition coil ZS. Devices are provided for detecting the primary voltage and the primary current and the secondary current.

A control unit SE generates the variable supply voltage Vsupply and the control signal IGBT_Control for the switching element IGBT as a function of the detected operating variables by means of the voltage converter DC/DC.

The control unit SE is in turn controlled by a microcontroller (not illustrated) which predefines the ignition time in real time for each ignition coil by means of separate timing inputs. Data can be exchanged between the microcontroller and the control unit SE via a further interface, for example the customary SPI (Serial Peripheral Interface).

The voltage converter DC/DC generates a supply voltage Vsupply from the 12 V vehicle on-board power system supply V_bat. The value of this supply voltage Vsupply can be controlled in a highly dynamic fashion by means of the control signal V_Control at the control input Ctrl of the voltage converter DC/DC in a range of, for example, 2 to 30 V. In this context, the voltage converter DC/DC can supply the necessary charging current for the respectively activated ignition coil ZS.

The ignition coil ZS used can be a customary type with a transmission ratio of, for example, 1:80, but it is possible to dispense with the blocking diode which is necessary in ignition systems which are customary today. Depending on the number of cylinders of the used spark ignition engine, for example 3 to 8 ignition coils are necessary. However, by virtue of the disclosed method it is possible to use an ignition coil with a significantly lower maximum level of storage energy.

The sparkplug ZK used can be a customary type. The precise configuration thereof is determined by the use in the engine.

The switching element IGBT can also be of a customary type with an internal voltage limitation of, for example, 400 V. However, its necessary current carrying capacity can be reduced as a function of the required charging current.

The signal V_Prim maps the primary voltage of the ignition coil ZS of up to 400 V, stepped down by means of a voltage divider composed of resistors R1 and R2, to a value range of, for example, 5 V which can be used for the control unit SE. The value of the voltage division is 1:80 in the specified example. The voltage divider R1, R2 is arranged between the connecting point of the primary winding of the ignition coil ZS and the switching element IGBT and the ground terminal 0. The ground terminal 0 is connected to the negative potential GND of the supply voltage Vsupply.

In order to measure the current through the primary winding of the ignition coil ZS, a resistor R3 is connected in series to the primary winding and the switching element IGBT. The charging current flowing through the resistor R3 generates a voltage I_Prim which represents the current.

In the same way, a resistor R4 is connected in series with the secondary winding of the ignition coil ZS. The secondary current flowing through this resistor R4 generates the voltage I_Sec which drops across the resistor R4.

The control unit SE comprises the voltage converter DC/DC and a control circuit Control. The latter protects the signals V_Prim, I_Prim and I_Sec and compares it with threshold values or setpoint values V1 . . . V5 by means of voltage comparators.

At the time which is predefined by the input signal timing of a microcontroller, the control unit SE triggers an ignition process, wherein the spark duration and the arc current are regulated. For this purpose, the supply voltage Vsupply is controlled by means of the control signal V_Control and/or the switching element IGBT is switched on and off by means of the control signal IGBT_Control. In the case of spark ignition engines with a plurality of cylinders, a plurality of timing inputs and a plurality of IGBT_Control outputs are to be correspondingly provided.

Furthermore, the control circuit Control is connected to the microcontroller via a SPI interface. In this way, the microcontroller can transmit predefined values for the charging current, spark duration, spark current and also predefined values for the configuration of a multispark ignition. In the opposite direction, the controller can transmit status and diagnostic information to the microcontroller.

In the text which follows, the method for operating the ignition device is to be explained in more detail with reference to FIG. 2. The method here comprises a plurality of successive phases.

1. Charging the Coil Inductance

At the start of the ignition, the main inductance of the ignition coil ZS is charged. For this purpose, the switching element IGBT is switched on at the time t1 by the control unit SE using the control signal IGBT_Control. The charging current is detected here as a signal I_Prim. Since no secondary-side blocking diode is used, the supply voltage Vsupply must be changed chronologically during the charging process in such a way that the voltage which is induced on the secondary side here reliably remains below the instantaneous breakthrough voltage. The value thereof is given substantially by the instantaneous combustion pressure which changes continuously during the compression stroke. It is important here that the charging current value which corresponds to the desired storage energy is reached at the latest at the ignition time t2. It is irrelevant here if the charging current value is reached somewhat earlier since the current can be kept constant by reducing the supply voltage Vsupply. The supply voltage Vsupply is adjusted here to a value which is given by the internal resistance of the primary winding and by the charging current. In addition, the voltage losses at the switching element IGBT and at the current measuring resistor R3 are also taken into account. The value of the energy which is to be stored can be different during each charging phase and correspondingly adapted, on the basis of the observation of the preceding ignition processes and after having been predefined by means of the SPI.

2. Breakdown

At the predefined ignition time t2, the switching element IGBT is switched off using the control signal IGBT_Control. The primary voltage and secondary voltage of the ignition coil ZS then increase rapidly driven by the collapse of the magnetic field.

Figure 2:
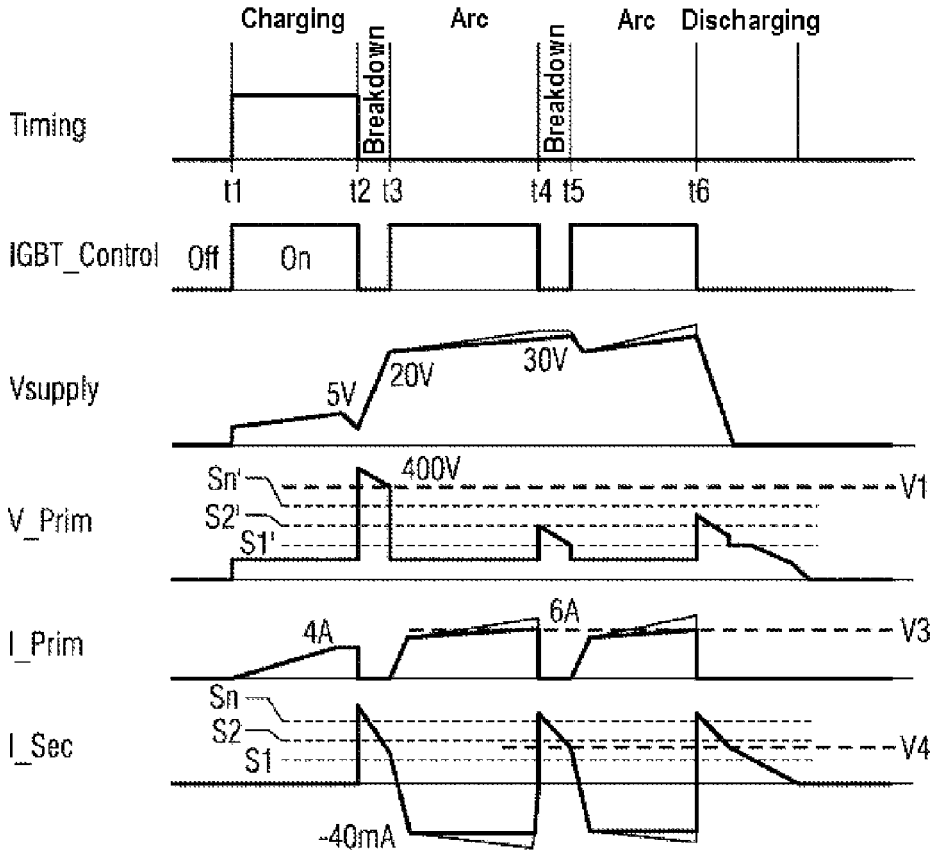
FIG. 2 shows a flowchart which clarifies the time relationships in conjunction with the threshold values.

The supply voltage Vsupply is quickly adjusted to its maximum value of for example 30V at the start of the breakdown phase by means of the control signal V_Control, which is not apparent in detail in FIG. 2.

3. Burning Phase (arc)

The start of the burning phase is detected as soon as the primary voltage of the time t3 drops below a predefined value of, for example, 40 V. The signal V_Prim which is derived therefrom by means of the voltage divider R1, R2 then has a value of, for example, 0.5 V and can be compared with a first threshold value V1 using a first voltage comparator. The output of the first voltage comparator changes its logic state when the setpoint value V1 is undershot. This change serves to switch on the switching element IGBT once more at the time t3. Since the supply voltage Vsupply is then set again to a high setting (30 V), this voltage is transmitted on the secondary side via the ignition coil ZS as a high negative voltage of, for example, −2.4 kV. Since at this time there is ionized gas between the electrodes of the sparkplug ZK owing to the light arc, a renewed breakdown takes place approximately at the arcing voltage of approximately −1 kV.

As a result of the voltage difference between the lamp voltage and the transformed primary voltage, a negative arcing current builds up very quickly. The rise is determined here substantially by the primary and secondary leakage inductances and the voltage drops across the winding resistors. The arcing current is detected here by means of a signal I_Sec using the resistor R4.

Since at the same time as the transmission of current to the secondary side the main inductance of the ignition coil ZS is also charged, the current flow thereof rises continuously. The latter is detected by means of the signal I_Prim at the resistor R3 and is compared with a second setpoint value V3 by means of a second voltage comparator. If the signal I_Prim rises above the second setpoint value V3 owing to the rise in the current, the switching element IGBT is switched off again at the time t4 by means of the control signal IGBT_Control.

The supply voltage Vsupply is in turn quickly adjusted to its maximum value of, for example 30V by means of the control signal V_Control.

As described under 2. Breakdown, the collapse of the magnetic field then drives the secondary voltage in the positive direction until a renewed breakdown with a subsequent arcing phase takes place at a voltage of approximately +1 kV. This renewed arcing phase is then fed by the energy previously stored in the main inductance, wherein the secondary-side arching current (which is now positive) decreases continuously. Since the renewed breakdown has taken place at a substantially lower voltage, significantly less energy is also necessary here for charging the secondary capacitance and the remaining residual energy corresponds substantially to the previously stored energy.

The secondary-side arcing current is now compared with a third threshold value V4 by means of the signal I_Sec, using a third voltage comparator. If the value of I_Sec drops below the third threshold value V4, the output state of the third voltage comparator changes and the switching element IGBT is switched on again at the time t5. As a result, a renewed arcing phase with a negative arcing current is described as above.

4. End of the Burning Phase

This cyclical change between negative and positive burning current can be repeated here as often as desired and is ended only by the predefined burning period of for example 1 ms. The switching element IGBT is then finally switched off. The energy which is stored in the ignition coil ZS at this time t6 then also dissipates in the arc, after which the arc is extinguished. The ignition process is ended.

In an inventive manner, at least one of the threshold values V1, V3 and V4 for the primary voltage V_Prim, the primary current I_Prim and the secondary current I_Sec can be varied in such a way that it depends on, on the one hand, as a function of engine state data such as, in particular, the rotational speed or the ignition time and, on the other hand, on the amplitude of the voltage at the secondary winding of the ignition coil. The voltage at the secondary winding of the ignition coil is mapped here by the easily measurable current through the secondary winding I_Sec or the voltage, transformed back by the ignition coil ZS, at the primary winding of the ignition coil ZS. In this context, the dependence on the engine state data can advantageously be formed by a characteristic data field which is updated in a cyclical fashion on the basis of the determined amplitude of the secondary current I_Sec or the primary voltage V_Prim. Alternatively, it is possible to select one characteristic data field from a plurality thereof. The amplitude of the secondary current I_Sec or of primary voltage V_Prim can be determined continuously here or else on the basis of predefined characteristic breakdown threshold values S1, S2, . . . , Sn and S1', S2', . . . ; Sn'.

Figure 3:
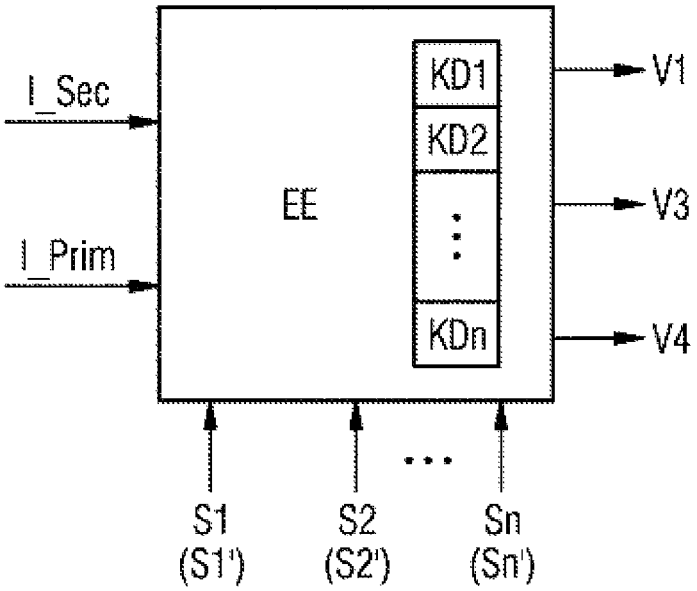
FIG. 3 shows a basic illustration of a control circuit.

This is illustrated schematically in FIG. 3. A determination unit EE which is embodied in the control circuit Control in FIG. 1 includes characteristic data fields KD1, KD2, . . . , KDn, of which one is selected on the basis of a signal which indicates which of the threshold values S1 . . . Sn or S1' . . . Sn' which are also fed to the determining unit or stored therein are exceeded by the secondary current I_Sec or the primary voltage V_Prim. Alternatively, as stated above, it is also possible to provide just one characteristic data diagram whose content is adapted on the basis of the signal.

Owing to this adaptation of at least one of the threshold values V1, V3 and V4 for the primary voltage V_Prim, for the primary current I_Prim and for the secondary current I_Sec, a targeted supply of energy in the ignition sparks is possible at specific times during the ignition time interval since the start of the arcing and breakdown phases can be influenced in a targeted fashion by the setting of the threshold values V1, V3 and V4.

The determining unit EE can be formed either by a microcontroller with software contained therein or by a hardware sequencing controller (state machine) which is composed of standard logic modules.

What is claimed is:

1. A method for operating an ignition device for an internal combustion engine, the ignition device having an ignition coil embodied as a transformer, a sparkplug connected to the secondary winding of the ignition coil, a controllable switching element connected in series with the primary winding of the ignition coil, and a control unit connected to the primary winding of the ignition coil and to the control input of the switching element, the method comprising:

the control unit providing a supply voltage for the ignition coil and a control signal for the switching element as a function of the currents through the primary winding and the secondary winding of the ignition coil and of the voltage between the connecting point of the primary winding of the ignition coil to the switching element and to the negative terminal of the supply voltage, transporting energy in the ignition sparks of the sparkplug by alternatively switching the switching element on and off as a function of threshold values for the primary voltage or a voltage derived therefrom, for the current through the primary winding of the ignition coil and for the current through the secondary winding of the ignition coil, being undershot or exceeded, determining at least one of these threshold values based on a function relating at least one threshold value to engine state data comprising rotational speed, during the phases in which the switching element is switched off, measuring the voltage induced in the secondary winding of the ignition coil using (a) a measured current through the secondary winding of the ignition coil or (b) a measured voltage, transformed back by the ignition coil, at the primary winding of the ignition coil, and changing the function relating at least one threshold value to engine state data based on the measured current through the secondary winding or the measured voltage at the primary winding.

2. The method of claim 1, wherein the function relating at least one threshold value to engine state data is defined by a characteristic data diagram.

3. The method of claim 1, wherein the engine state data further comprises an ignition time.

4. The method of claim 1, comprising measuring the current through the secondary winding of the ignition coil or of the measured voltage at the primary winding discretely using breakdown threshold values.

5. An ignition device for an internal combustion engine, the ignition device comprising:

an ignition coil embodied as a transformer having a primary winding and a secondary winding, the secondary winding configured for connection to a sparkplug, a controllable switching element connected in series to the primary winding of the ignition coil, and a control unit connected to the primary winding of the ignition coil and to a control input of the switching element, the control unit comprising:

a voltage converter which provides a supply voltage for the ignition coil and which is configured for connection to a motor vehicle on-board power system voltage, and a control circuit configured to change one or more threshold values for the primary winding voltage or a voltage derived therefrom, the current through the primary winding of the ignition coil, and the current through the secondary winding of the ignition coil as a function of the current measured during the off phases of the switching element, through the secondary winding of the ignition coil or as a function of the voltage measured at the primary winding of the ignition coil, which voltage occurs as a result of back transformation of the voltage at the secondary winding of the ignition coil by the ignition coil, wherein one or more of the threshold values is determined based on a function including engine state data comprising rotational speed.

6. The ignition device of claim 5, wherein a characteristic data diagram is stored in the control circuit, the characteristic data diagram assigning a number of different characteristic data to a corresponding number of values for the current through the secondary winding or the voltage at the primary winding of the ignition coil.

7. The ignition device of claim 5, wherein the function relating at least one threshold value to engine state data is defined by a characteristic data diagram.

8. The ignition device of claim 5, wherein the engine state data further comprises an ignition time.

9. The ignition device of claim 5, wherein the control unit is configured to measure the current through the secondary winding of the ignition coil or of the measured voltage at the primary winding discretely using breakdown threshold values.

* * * * *